United States Patent [19]

Van Gundy, Jr.

[11] 4,199,033

[45] Apr. 22, 1980

[54] AUGERING ACCESSORY FOR BACKHOE OR THE LIKE

[76] Inventor: Joe F. Van Gundy, Jr., 710 Big Rock Ave., Plano, Ill. 60545

[21] Appl. No.: 902,076

[22] Filed: May 2, 1978

[51] Int. Cl.[2] ..... E21C 11/02

[52] U.S. Cl. ..... 173/27; 37/117.5; 173/29; 173/43

[58] Field of Search ..... 37/117.5; 173/22, 23, 173/24, 27, 28, 29, 43, 46

[56] References Cited

U.S. PATENT DOCUMENTS

| | | | |
|---|---|---|---|
| 1,885,295 | 11/1932 | Robinson | 173/27 X |
| 2,969,844 | 1/1961 | Hamrick | 173/27 X |
| 3,327,789 | 6/1967 | Furuseth | 173/38 |
| 3,460,691 | 8/1969 | Wieger | 214/141 |
| 3,563,320 | 2/1971 | Von Ruden | 173/27 |
| 3,746,104 | 7/1973 | McIntosh et al. | 173/43 |
| 3,922,017 | 11/1975 | Cobb | 173/43 X |
| 4,066,134 | 1/1978 | Karns | 173/27 |
| 4,068,728 | 1/1978 | Subrick | 173/27 |
| 4,099,579 | 7/1978 | Stormon | 173/28 X |

FOREIGN PATENT DOCUMENTS

| | | | |
|---|---|---|---|
| 1328794 | 9/1973 | United Kingdom | 37/117.5 |

*Primary Examiner*—Lawrence J. Staab
*Attorney, Agent, or Firm*—Kalish & Gilster

[57] ABSTRACT

Augering apparatus is intended for attachment as an accessory to a hydraulically operated boom of a backhoe or the like, the boom having articulated first and second members, the first member being pivotally attached to a tractor and the second member of the boom having a distal end hydraulically positionable in azimuth, elevation and reach from the tractor, and points of attachment for a scoop or the like. Such scoop is replaced by the accessory which includes a mounting bracket for being carried by transverse pins normally present at the end of the boom for mounting the scoop. The bracket carries a yoke in swiveling relationship for movement about a swivel axis lying in the plane of articulation of the boom members, the yoke having first and second oppositely disposed pivot members. A motor enclosure has pivot cooperative members, preferably trunions extending from opposite sides thereof, for pivotally cooperating with the yoke. The enclosure contains a selectively reversible hydraulic motor. A coupling for receiving the shank of an auger is carried by a shaft driven by the motor and extends from one end of the enclosure. Hydraulic lines supply hydraulic fluid for operation of the motor, these lines preferably being connected at the trunions. The trunnions provide a pivot axis which is offset from the swivel axis for castering action of the motor enclosure in response to augering forces.

15 Claims, 11 Drawing Figures

AUGERING ACCESSORY FOR BACKHOE OR THE LIKE

BACKGROUND AND SUMMARY OF THE INVENTION

The present invention relates to boring or augering apparatus and, more particularly, to a hydraulically operated augering apparatus for attachment to the boom of a backhoe or the like.

For the purposes of digging trenches and other earth excavation, it is common practice to employ a so-called backhoe which is a hydraulically powered implement mounted to the rear of a tractor or similar machine and having an articulated boom extending rearward from the tractor, with the distal end of the boom being hydraulically positionable in azimuth, elevation and reach from the tractor and having a scoop mounted at the distal end for convenient trenching or other excavation while the tractor remains in the same stationary location. The articulated boom configuration of a backhoe facilitates trenching and other similar excavation by permitting the backhoe scoop to reach down into an excavation and the articulated boom arrangement readily facilitates reaching over the lip of an excavation area. In such excavation, it is frequently desirable to bore or auger into the face of the excavated surface, e.g. for the purpose of placing pipe under a pavement or other area adjacent the excavation. Thus, it is not unusual to excavate adjacent a pavement where it is desirable then to bore or auger beneath the pavement in order to avoid trenching or otherwise disrupting the surface of the pavement.

Heretofore, apparatus has been disclosed for use with a backhoe for such purpose. For example, Hamrick U.S. Pat. No. 2,969,844 discloses an earth boring implement particularly for use with a backhoe having an auger drive assembly comprising a drive shaft rotatably secured to a frame, the frame having frame members which extend transversely of the earth boring implement between the side walls of the scoop, such frame members being bolted to the sides of the scoop. The drive assembly thus has a shaft which is rotatable about an axis which extends out from the scoop of the backhoe, the arrangement being such that the axis is pivotable in a vertical plane and, more specifically, is permitted to pivot in the plane of articulation of the boom members. The drive assembly is rotated by a hydraulic motor by means of a chain and sprocket arrangement connecting the hydraulic motor to a sprocket which rotates the shaft to which an auger is secured. The Hamrick implement thereby permits boring by means of an auger or drill bit, but with the axis of the bit always remaining in the plane of articulation of the boom member. Since boring may not be carried out by such apparatus at an angle to the plane of articulation of the boom members, the apparatus is extremely limited in utility owing to the inability to locate the drill bit or auger axis at any angle different from the plane of articulation of the boom members.

To illustrate the difficulty inherent in such limitation, one may appreciate that it is often desired to auger into the face which terminates a trench excavation. While the Hamrick earth boring implement could be utilized for boring into the face at the end of a trench excavation, it would require that the tractor be located so that it is substantially in line with the axis of the trench. This is difficult and frequently impossible, owing to geographic limitations, the presence of buildings, or various other factors which must be taken into consideration in locating a tractor in a stable and secure location for the excavation. For example, if the trench is adjacent to a pavement and extends along said pavement but spaced therefrom by distance, it would be desirable to locate the tractor upon the pavement in order to avoid having the heavily laden rear wheels thereof on the soft earth adjacent the trench. In this instance, it would be impossible with the Hamrick implement to drill along the axis of the excavation. Moreover, the Hamrick apparatus would not permit boring to be accomplished into an excavation face which is facing toward the tractor, inasmuch as the boring implement may only be moved through a limited arcuate extent within the plane of articulation and, at either arcuate extent, is then limited by the degree of tipping movement permitted by the backhoe apparatus. A further disadvantage inherent in the Hamrick configuration is that the auger is not permitted to swing in a lateral axis since it is secured by the above noted frame arrangement to the sides of the bucket. Hence, any lateral movement of the auger would impose great strain upon the backhoe with the possibility of consequent damage thereto.

A vehicle mounted hole driller is disclosed by Furuseth U.S. Pat. No. 3,327,789. The apparatus disclosed in this patent has an earth auger universally mounted in depending relation to one side of the center of a tractor-carried frame, such as the frame of a fork loader or the like. Such apparatus is useful chiefly for post hole drilling and other drilling of primarily vertical holes in earth. The Furuseth apparatus is not useful for drilling into the face of an excavation at various depths and angles, inasmuch as it is incapable of reaching down into an excavation as a backhoe is capable of doing.

An earth boring machine is also disclosed by Von Ruden U.S. Pat. No. 3,563,320. Such machine has an auger for boring down into the earth adjacent the machine. The auger can be tilted at various angles relative to the vertical, but such machine is not useful for reaching down into an excavation and does not permit boring of a hole at various angles into the face of an excavation for such reason.

Wieger et. al. U.S. Pat. No. 3,460,691 discloses a telescopic dredge having a boom which may be oriented at various angles for reaching down into an excavation. Various tools can be mounted to the end of the boom, including an auger. However, the construction is apparently incapable of permitting orientation of the auger at various angles for drilling into various faces of the excavation and appears to be limited to a capability of drilling along an axis coaxial with the boom. Hence, its capability is even more limited than the earth boring implement of the above identified Hamrick patent.

Various excavation apparatus is taught by the prior art having pivots and swivels for facilitating the orientation of a tool, but none is known which provides for the fitting of a hydraulic boring unit to a hydraulic backhoe so as to provide full swivel in both horizontal and vertical planes and orientation of the drill in various positions other than vertical and other than in the plane of articulation of the boom members of the backhoe. Moreover, none of the prior art arrangements are such as effectively to utilize the augering force for inherent self-centering of the auger so as to prevent misalignment of augering.

The present invention overcomes these and other limitations of the prior art constructions.

An object of the present invention is to provide an improved augering apparatus for attachment to the boom of a machine for earth excavation, and particularly to provide such an augering apparatus which is specially adapted for convenient attachment to the hydraulically operated boom of a tractor-mounted backhoe or the like.

A further object of the invention is the provision of such apparatus which is intended to replace the scoop, i.e. bucket, of a backbone and is amenable to securement to the boom of the backhoe by the same means which conventionally secures such scoop to the backhoe.

Another object of the invention is the provision of such augering apparatus which is adapted for securement to the boom of a hydraulic backhoe in such manner as to provide full swiveling and pivoting in both horizontal and vertical planes and which permits the orientation of the drill in various positions so that the axis of rotation thereof may be oriented as desired, including orientation at an angle to the plane of articulation of the boom, whereby drilling is not limited only to the plane in which the boom of the backhoe moves normally.

A related object is the provision of such augering apparatus having swivel and pivot features allowing the unit to swivel to more than 180° in a vertical plane and permitting the auger axis to be positioned through 360° in the horizontal plane.

A still further object of the invention is the provision of such apparatus which is such as to provide for the avoidance of bending stress on the auger and the backhoe boom, and particularly such a configuration as provides a self-centering characteristic in response to augering thrust forces so as to avoid misalignment of the auger.

Yet another object of the invention is the provision of such augering apparatus which is hydraulically powered by means of a hydraulic motor for rotation of the auger, and the provision of such apparatus providing for proportioning of pressure of hydraulic fluid between the boom and the hydraulic motor for advantageous control selection of control effectiveness for positioning of the boom while augering is being carried out by the apparatus.

A related object of the invention is the provision of such hydraulically powered augering apparatus which provides hydraulic fluid for operation of such motor by means of flexible hydraulic lines which are connected in such a way as to avoid bending stress upon the hydraulic lines and damage thereto during augering.

Other objects of the invention include the provision of such augering apparatus which greatly facilitates the removal and installation of an auger from the augering apparatus while the apparatus is secured to the boom of a backhoe, the provision of such apparatus which is relatively simple, strong, durable and economical to manufacture.

Other objects and features will be apparent or pointed out hereinbelow in the following description.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
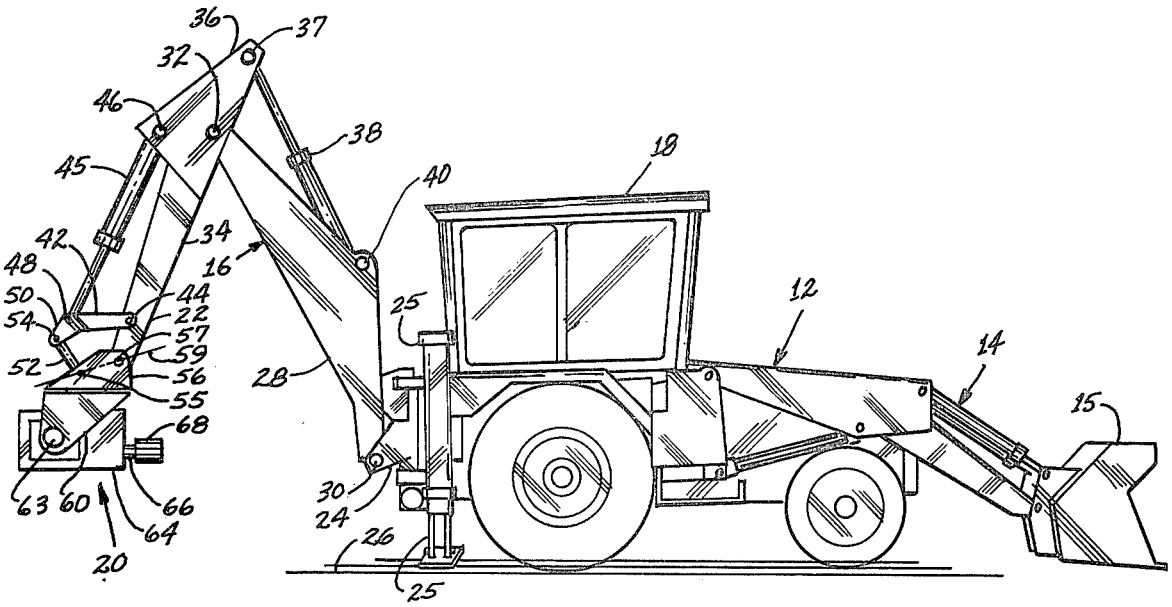
FIG. 1 is a side elevation of a tractor equipped with the boom of a hydraulically operated backhoe, said boom having augering apparatus secured thereto.

Referring now to FIG. 1, indicated generally at reference numeral 12 is a tractor of conventional configuration equipped with a front loader 14 including a scoop 15 and also equipped with the boom of a backhoe which boom is generally designated at 16. The backhoe 16 and front loader 14 are of a hydraulically operated type and are controlled in conventional manner by the backhoe operator from a cab or operating compartment 18 by manipulation of conventional hydraulic controls contained therein.

Generally designated at 20 is apparatus of the present invention which replaces a scoop, or bucket, which is normally carried at the end of boom 16.

Boom 16 may be moved from side to side for azimuthal positioning of the distal end 22 of the boom by rotation about a vertical axis through a pivot assembly 24 at which the boom 16 is attached to the tractor. Such actuation is carried out by hydraulic cylinders (not shown) in conventional manner. Adjacent this pivot assembly 24 is one of a pair of jack stands 25 which may be of a hydraulic type having a footpad 25 which is lowered to the ground 26 upon which the tractor is located for stabilizing the tractor during excavation.

The boom comprises a first boom member 28 having a proximal end pivotally secured as indicated at 30 to vertical pivot assembly 24. A hydraulic cylinder (not shown) controls vertical movement of the boom member 28. Pivotally secured as indicated at 32 to the distal end of boom member 28 is the proximal end of a second boom member 34. Boom member 34 has a portion 36 extending to one side of pivot 32 and interconnected pivotally at 37 to hydraulic cylinder 38 pivotally connected at 40 to the first boom member 28 for positioning of boom member 34 relative to boom member 28. Thus, the boom members are articulated for articulating movement about pivot 32 in response to actuation of hydraulic cylinder 38.

One of a pair of arms 42 is visible in FIG. 1, being pivoted as indicated at 44 near the end of the boom for movement in response to a hydraulic cylinder 45 having one end pivotally connected as indicated at 46 to one end of boom member 34 and the other end connected pivotally as indicated to each of arms 42 as indicated at 48. Extending from the end 50 of arm 42, it being understood that there are two such arms, is a link 52 having one end pivotally secured as indicated at 55 to a bracket 56 forming part of the invention, as later to be described. For the present, however, it is sufficient to note that there are two such links 52, one for each of arms 42. These links 52 appear more clearly in FIGS. 2 and 4. Although bracket 56 will be described more specifically hereinbelow, it should be noted for the present that such bracket is pivotally secured as indicated at 58 to the proximal end of boom member 34. Pivot connections which are indicated at 54 and 58 comprise pins each extending transversely to boom member 34, and such pins extending transversely to boom member 34, and such pins extending through the ends of both of the links 52, only one such link being visible in FIG. 1, and also extending through distal portion 22 of the boom. These two pins are retained in position by spring clips, etc. The pins are parallel and as will be apparent, form a plane of attachment 59. Ordinarily, attached thereto is a scoop, or bucket, of a backhoe, such scoop having been removed for installation of apparatus 20 in its place. As will be apparent, actuation of cylinder 45 causes tipping of this plane of attachment about a pivot axis extending lengthwise through pin 58.

Secured in swiveling relationship to bracket 56 is a yoke 60. Said yoke is pivotally secured by means of a trunnion 63 to the enclosure of a hydraulic drill motor unit 64, Hydraulic lines extend between the tractor and enclosure of unit 64, but these are not shown in FIGS. 1–4, in the interest of simplifying the drawings. Extending from one end of drill unit enclosure 64 is a shaft 66 driven by a hydraulic motor of a conventional type housed within enclosure 64. Carried by said shaft 66 is a coupling 68 having a socket adapted to receive the shank 70 (FIG. 2) of an auger 72.

Figure 3:
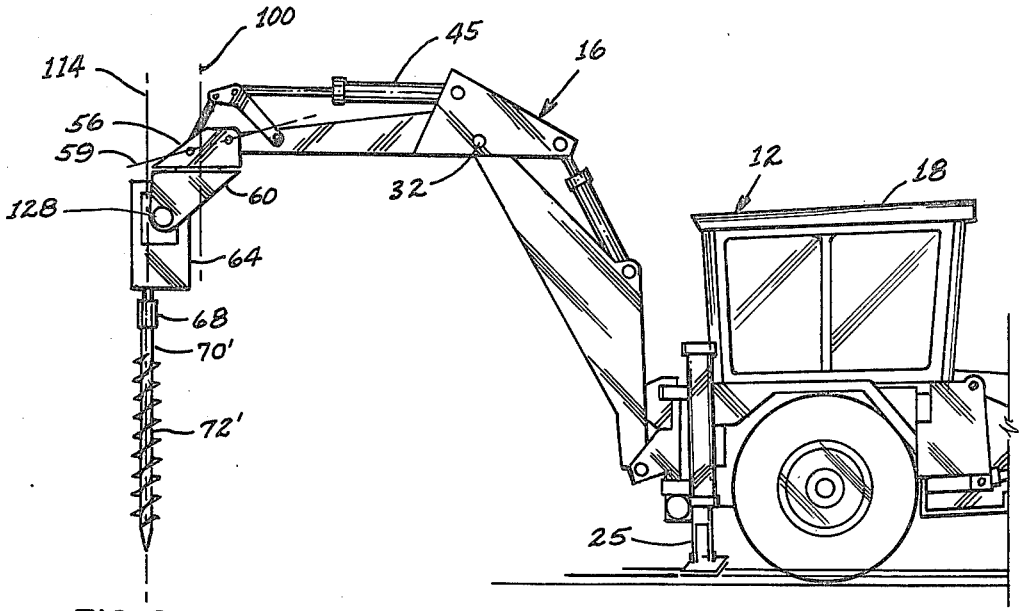
FIG. 3 is a side elevation of portions of a tractor with the boom secured thereto, and depicting the augering apparatus of the present invention with the lengthwise axis of the auger in a vertical orientation for augering vertically into the surface upon which the tractor stands.

Such shank 70 may be of desired length, FIG. 3 illustrating an auger 72' having a shorter shank 70' received by the coupling 68 which extends from motor enclosure 64. In addition, the auger may be of desired diameter, up to several inches in size. For example, an apparatus has been found suitable for use with augers up to and including 24 inches in diameter. For the purpose of driving large diameter augers, suitable reduction gearing may be included within housing 64 and preferably the entire motor housing 64, containing a hydraulic motor and suitable reduction gearing, and provided with said shaft 66 and coupling 68 thereon may be acquired as a commercial assembly from the Lowe Company, Dubuque, Iowa. Hence, the specific details of the motor and reduction gear features contained within enclosure unit 64 are not presently described. However, such enclosure 64 is modified, in accordance with the invention, to construct the present apparatus.

With these general features of the invention in mind, it should be apparent now that the distal end 22 of boom member 34 (and thus the distal end of the boom) is hydraulically positionable in azimuth, elevation and reach from tractor 12.

Figure 5:
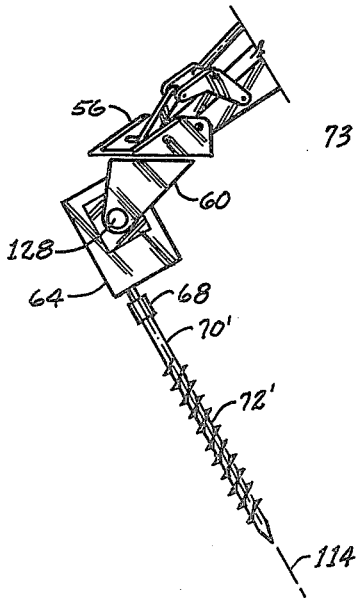
FIG. 5 is a vertical elevation of augering apparatus of the present invention and portions of the backhoe boom to which it is secured taken along line 5—5 of FIG. 4.
Figure 4:
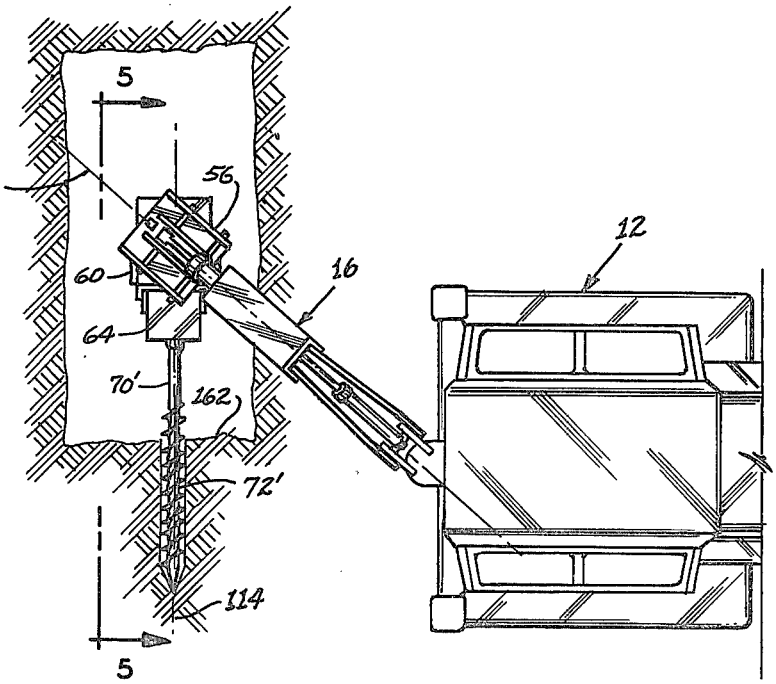
FIG. 4 is a top plan view of portions of the tractor, boom, and the new augering apparatus and showing in horizontal sectional view an excavation area to provide an illustration of use of the present augering apparatus for augering into a face of the tractor at an angle to the plane of articulation of the boom and at an angle to the lengthwise axis of the tractor.

FIGS. 3, 4 and 5 illustrate various configurations of the boom having the new apparatus 20 attached thereto. FIG. 3 is indicative of articulating movement of boom members 28 and 34 by pivoting at pivot point 32 in response to actuation of hydraulic cylinder 38. Hence, the boom members are relatively movable in a plane of articulation, such plane being illustrated by phantom lines in FIG. 2 and being designated at 74.

Referring now to FIGS. 6–10, apparatus 20 of the present invention is illustrated in greater detail. Bracket 56 of the new apparatus is seen to comprise a transverse web 74 constituted by a flat plate of sheet steel. A pair of side webs 76, 76' extend upward from transverse web 74 and are integrally joined to the latter by welding as indicated at 78. Side webs are preferably also of flat plates of steel sheet material. A pair of steel rods 79 are welded to and extend between the opposite interior faces of webs 76, 76' for desirable additional stiffening of the structure against side loads which may result particularly when augering at an angle to the plane of articulation, as shown for example in FIG. 4.

Each of the upright webs 76, 76' is provided with a pair of apertures for receiving the transverse pins 22 and 55 which ordinarily secure a bucket or scoop to the backhoe boom 16. Such pins are typically secured by spring clips, keys or the like. Thus, web 76 is provided with apertures 80, 81 and web 76' has apertures 80', 81'. Each of these four apertures is provided with a suitable bearing surface for receiving the pins. These bearings may be in the form of sleeves or collars provided by short cylindrical sections of tubing welded in place or by washers or the like welded on opposite sides of the respective upright webs concentric with said apertures. Such sleeves or collars are designated at 83, 83' and 84, 84'. In cross-section, bracket 56 is channel-shaped, as best viewed in FIG. 8.

Figure 6:
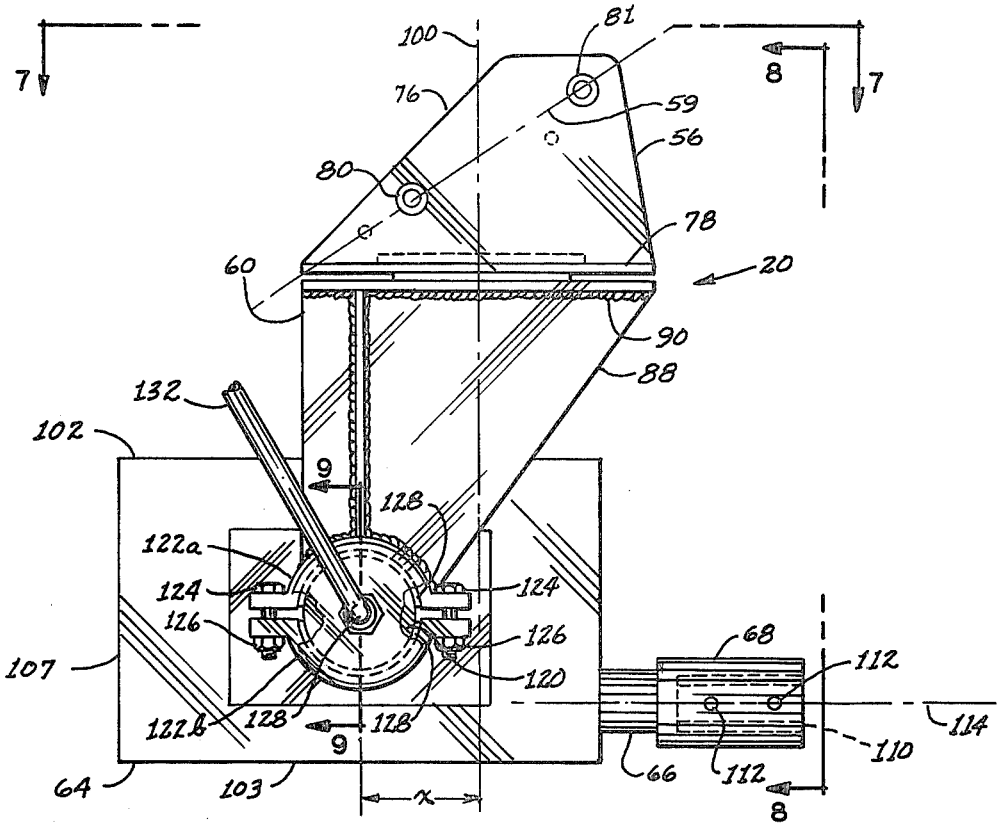
FIG. 6 is a side elevation of augering apparatus of the invention, with a certain trunnion flange of the apparatus being shown broken away.
Figure 8:
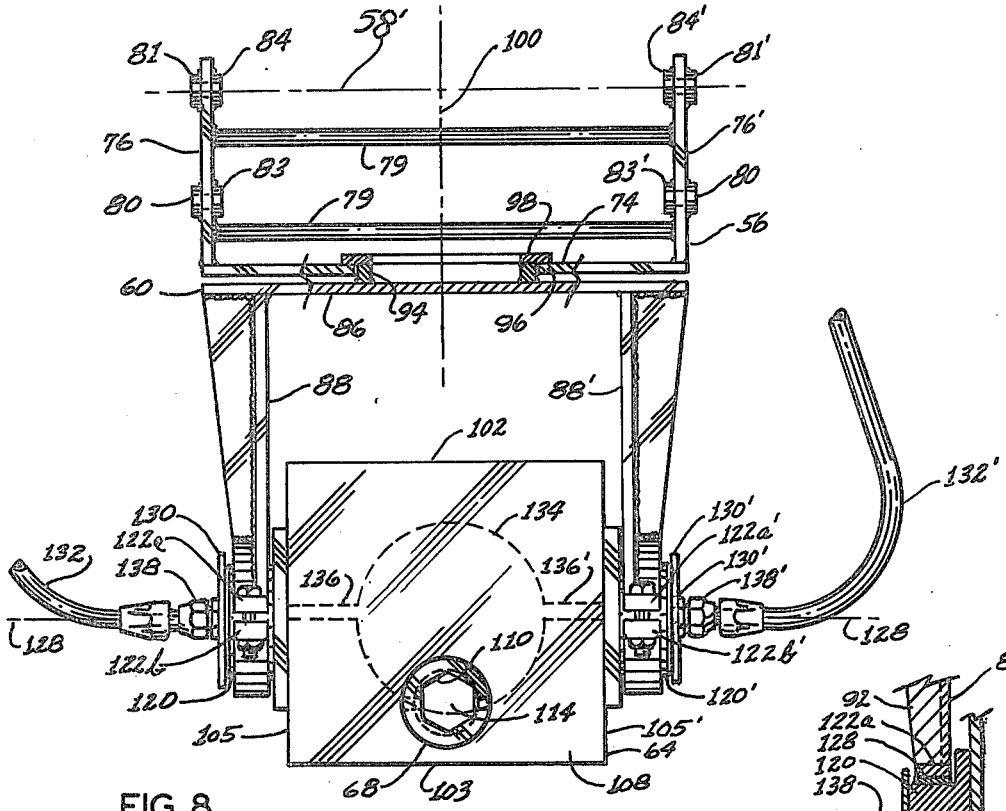
FIG. 8 is a front elevation of the apparatus taken along line 8—8 of FIG. 6.

Referring still to FIG. 8, yoke 56 is seen also to be of channel-shaped cross-section, having a transverse web 86 constituted by thin sheet of flat plate steel, there being at the opposite sides thereof in opposed disposition a pair of side webs 88, 88' of the same steel plate material and welded to plate 86, as illustrated representatively in FIG. 6 at 90. Stiffening webs 92, 92' are welded exteriorly to upright web portions 88, 88' of the yoke assembly, these being welded also to transverse web 86 for strengthening the structure of the yoke relative to plate or web member 86. Yoke web 86 is secured to bracket transverse web 74 by means of a short right cylindrical collar 94 welded at its lower periphery to the upper surface of yoke transverse web 86 and having an annular flange 98 welded to the upper periphery of collar 94 and extending radially outward therefrom and radially outward also of the aperture 96 for securing the yoke to the bracket in swiveling relationship. Thus, the bracket is free to turn about a swivel axis 100 normal with respect to both plates 74 and 86 and lying in the plane of boom articulation 74 regardless of re-orientation of the plane of attachment 59 about the tipping axis 58', as will be apparent from FIGS. 8 and 10. Hence, the swivel axis 100 is normal to the tipping axis 58', but these axes do not intersect.

The hydraulic power unit 64 is pivotally secured between side webs 88, 88' of the yoke. The enclosure of said power unit has top and bottom surfaces 102, 103, side wall surfaces 105, 105', a rear wall 107, and a front wall 108. Shaft 66, which carries coupling 68, extends from said front wall, being centered laterally at the front wall and located proximate to the lower edge thereof. As viewed in FIG. 8, coupling 68 is provided with a hexagonal socket opening 110 for receiving the shank 70 of an auger having a portion adjacent its end of complementary cross-section. Coupling 68 is provided with apertures representatively shown at 112 for securing the shank of the auger within the coupling 68 by keys or the like. Rotation of the coupling 68 and the auger is about an axis of rotation 114 identified in FIGS. 6, 7, 8 and 10.

Figure 9:
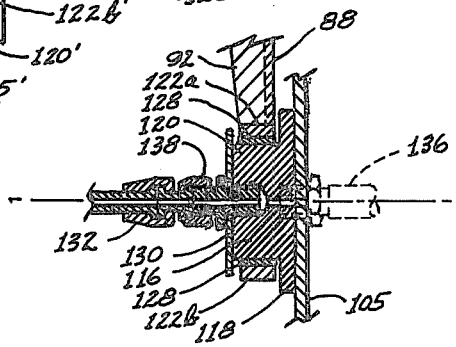
FIG. 9 is a cross-section of a trunion assembly of the invention and a swivel hydraulic fitting for interconnection of hydraulic lines.
Figure 10:
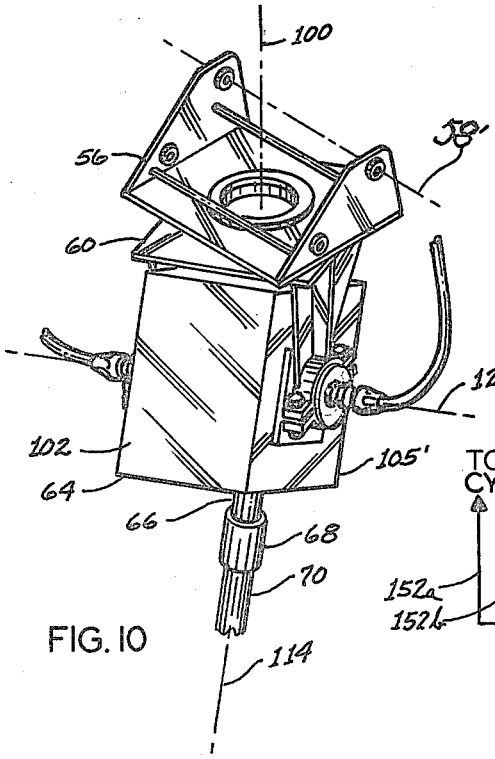
FIG. 10 is a perspective view of the apparatus for illustrating pivoting and swiveling action of its component parts.

The side walls 105, 105' of the hydraulic power unit 64 are pivotally secured to side webs 88, 88' of the yoke 60 by means of trunnion and trunnion sleeve bearing assemblies which are illustrated by the cross-sectional view of FIG. 9. There, it will be apparent that each of the side walls, e.g., side wall 105, of the hydraulic unit enclosure, is provided with a trunnion 116 extending outwardly therefrom, said trunnion having a flange portion 118 and a cylindrical portion 120 extending outwardly from the flange and providing a trunnion surface. Similarly, side wall 105' is also provided with a corresponding trunnion 120'. Each of the trunnions is received by a sleeve bearing assembly which is carried by the yoke side web members.

Referring to FIG. 6, side web member has a first half-sleeve bearing **122*a* having bolted thereto a second half-sleeve bearing 122*b* by means of bolts 124 secured by nuts 126. Trunnion 120' is similarly secured by semi-cylindric bearing sections 122*a'*, 122*b'*. Interposed between each of these trunnion surfaces and the corresponding surfaces of the semi-cylindric portions 122*a*, 122*a'* and 122*b*, 122*b'* are arcuate sections of frictional material 128 of the type of composition material, e.g. asbestos, used for brake linings, providing a bearing surface between the semi-cylindric bearing surfaces and the trunnion surfaces which is of a frictional character, it being understood that by tightening of the bolts and nut assemblies 124, 126 that the material may be adjustably compressed as desired for imparting a preselected friction between the respective trunnion and trunnion receiving surfaces of the side web members upon the tightening of the bolt and nut assemblies. The purpose of this friction arrangement is explained more clearly hereinbelow. Hence, the hydraulic power unit 64 is pivotally secured by these trunnion and trunnion receiving, or bearing, assemblies to the side web members 88, 88' for rotation about a pivot axis 128 which is normal to, but does not intersect, the swivel axis 100, and which is also normal to, but does not intersect, auger axis 114**.

In order to positively secure each of the trunnions in the trunnion receiving bearings, each trunnion is provided with the respective annular flange 130, 130' welded to the outer end of the trunnion, as best seen in FIG. 9.

Although, as noted, hydraulic power unit 64 is of a commercially available design, it is modified in accordance with the invention by securing the trunnions 116, 116' to the side walls 105, 105' thereof as by welding. The trunnions are preferred as the point of attachment for flexible hydraulic lines 132, 132' which are connected at the opposite sides of the unit. These lines supply hydraulic fluid pressure for operation of the hydraulic fluid motor which is contained within unit 64, such motor being respresentatively illustrated by dashed lines 134. As will be understood, typically it is desired to drive an auger of the type presently contemplated at a rotational speed which is less than that of motor 134 and for this purpose, suitable reduction gearing is included within unit 64, but it is not here illustrated. In any event, it is desirable that motor 134 be of a selectively reversible nature and thus hydraulic fluid may enter one line 132 and leave via the other line 132' or vice versa, these lines being internally connected as illustrated at 136, 136' in suitable fashion within the motor enclosure.

Alternatively, the two hydraulic fluid lines 132, 132' may enter and emerge from, or be connected at, the rear face 107 of the hydraulic power unit enclosure. However, it is presently contemplated that, in order to avoid excessive bending stress upon the flexible hydraulic lines and provide a greater degree of freedom of movement, they are secured coaxially with the trunnions. For this purpose, swivel hydraulic fittings such as that illustrated at 138 are shown in FIG. 9. Thus, the enclosure of hydraulic power unit 64 is free to pivot about pivot axis 128 without imposing undesirable excessive bending or twisting stress upon the hydraulic lines 132, 132'. Swivel fitting 138 and its counterpart 138' at the opposite side of the enclosure may be of a conventional design. Although in-line fittings are shown, elbow fittings may be used for even more compactness and to provide improved conformal routing of the hydraulic lines from the hydraulic power unit.

The other ends of the flexible hydraulic lines 132, 132' are suitably interconnected with the hydraulic system of tractor 12. However, connection of the flexible hydraulic lines 132, 132' to the source of hydraulic fluid at the same pressure as that which supplies hydraulic fluid for operation of the boom control cylinders for pivoting movement about pivot assembly 24 or for actuation of cylinders 38 and 45 is not preferred. Such connection results in a difficulty in that, during augering operation with an auger secured to the unit 20 and with the auger under rotation in response to hydraulic fluid supplied to motor 134, any movement of the distal end 22 of the hydraulically positioned boom (as will be necessary to control positioning of the auger and re-positioning of the unit as the auger bores into the earth) will be extremely over-sensitive and over-powered inasmuch as full hydraulic pressure normally available for normal actuation of the various hydraulic cylinders which position the distal end of the boom would also be provided by the tractor for simultaneous operation of the fluid motor 134 and the boom cylinders. To preclude difficulties of this type while repositioning of the boom elements during augering, it has been found desirable to reduce pressure for operation of the boom positioning cylinders when augering is taking place. For this purpose, a hydraulic system modification as depicted in FIG. 11 is preferably employed.

Figure 11:
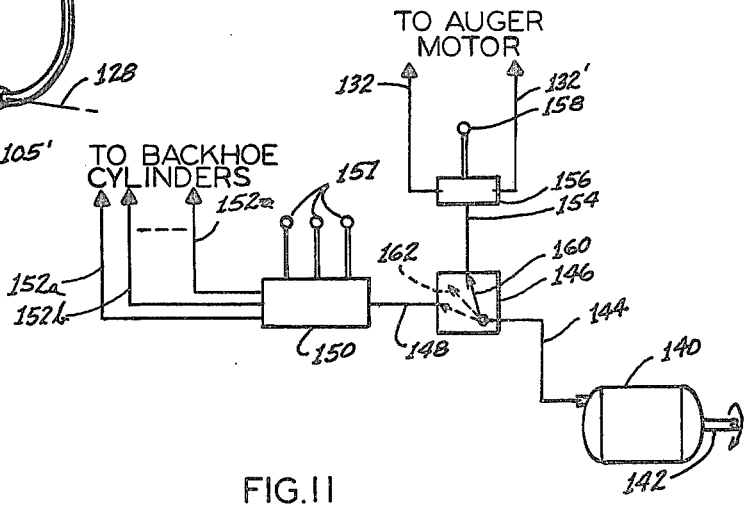
FIG. 11 is a schematic diagram of certain hydraulic interconnections including a proportioning valve utilized in accordance with the present disclosure.

Referring to FIG. 11, a source of hydraulic fluid pressure, i.e. the conventional hydraulic pump of the tractor is illustrated at 140. Said pump draws hydraulic fluid from an appropriate reservoir (not shown) in response to rotation of a shaft 142 driven by the tractor engine. Hydraulic pressure is thus made available via a hydraulic line 144. Such pressure is provided to a proportioning valve 146 having a fluid pressure line 148 extending therefrom to an arrangement of the usual control valves 150 which are operated by control levers 151 for positioning of the hydraulic boom. This valve arrangement has a plurality of hydraulic lines such as those representatively illustrated at 152*a*, 152*b* and 152*n* to provide hydraulic pressure to the various hydraulic cylinders for positioning of the boom. Return lines also are interconnected with the valve means 150 and with the fluid reservoir but such interconnections are not shown since they will be understood to those who are familiar with the provision and interconnection of hydraulic systems.

Valve 146 also has a fluid pressure line 154 extending therefrom to a control valve 156 for controlling the operation of hydraulic motor 134. Fluid pressure lines 132, 132' are shown extending from valve 156, it being understood that hydraulic fluid will be made available under pressure through one of these lines 132, 132' and returned via the other of the lines according to the positioning of a control handle 158. Valve 146 is of a type suitable for proportioning between lines 148 and 154 by selective positioning a valve element 160 within the body of the valve 146 to provide positions at one extreme for providing all of the fluid pressure to valve 156 for operation of the auger motor or for providing all of the fluid pressure to valve means 150 for operation only of the boom and with various intermediate positions such as that illustrated at 162 providing proportioning of the pressure between the boom cylinders and the auger motor. Accordingly, the valve 146 can be manipulated to provide greatly reduced pressure for operation of the backhoe cylinders via lines 152*a*, 152*b* through 152*n* and yet provide much greater pressure to the auger motor via line 132 or line 132'.

As will be apparent, if the auger is to be forced into the earth in a position such as that illustrated in FIG. 4 wherein the auger axis 114 is at a substantial angle to the plane of articulation 73 of the boom 16, i.e., for continued augering into the face of the excavation, the boom members will have to be re-oriented by hydraulic positioning thereof so as to create the desired repositioning of unit 64. This must not be done with excessively jerky or overpowered movement such as might result if full hydraulic pressure were available to the hydraulic cylinders for positioning of the distal end of boom 16. To do so could impose high bending moments and shear stresses of the auger shaft 70' or upon the connecting pins, the brackets 56 or yoke 60 of the apparatus, causing possible damage thereto. Hence, it will be then appreciated that the hydraulic arrangement of FIG. 11 permits augering to be continued with substantial augering power made available by hydraulic power unit 64, yet permits extremely gentle, careful and even delicate positioning of the boom by virtue of the lowered hydraulic pressure for the boom actuating cylinders.

Figure 2:
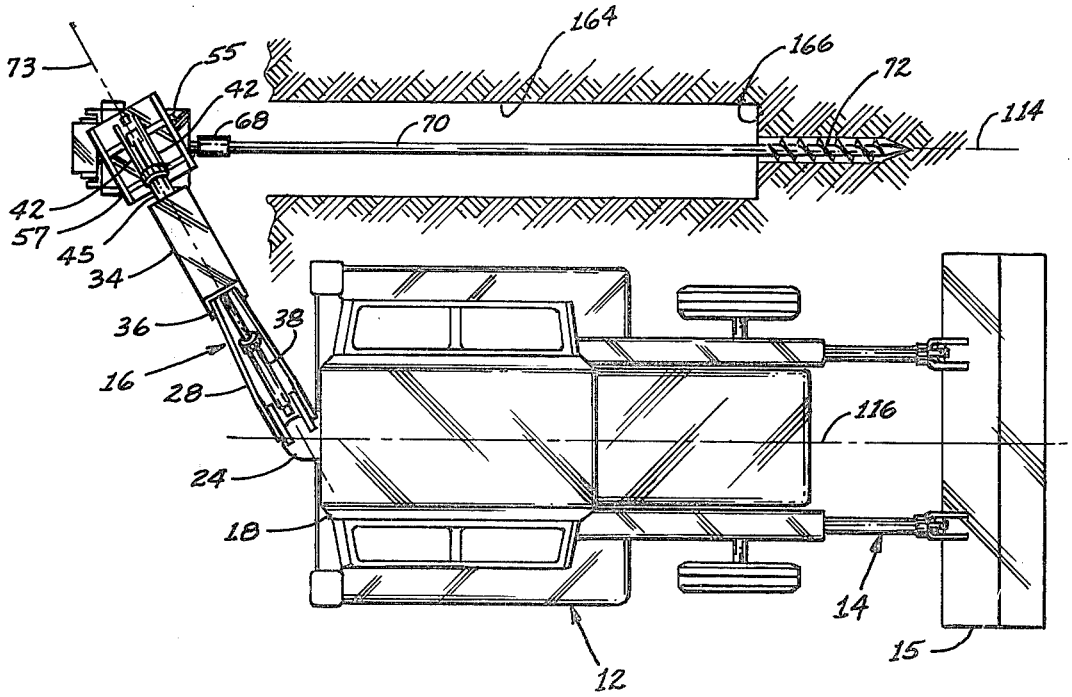
FIG. 2 is a top plan view of the tractor, the backhoe boom and augering apparatus of the present invention with an auger connected to the apparatus and showing, in horizontal sectional view through a trench, the manner in which the auger may be utilized by means of the apparatus for augering into a face of the trench along an axis parallel to the tractor.

Various advantages of the new apparatus will be appreciated from other views of the drawings. For example, FIG. 2 illustrates the possibility of augering with the augering axis 114 in a trench 164 parallel to the longitudinal axis of tractor 12. Since the boom 16 can be positioned to locate the hydraulic power unit 64 with the drill axis 114 in the orientation shown, augering is possible with the tractor located on a surface such as, for example, the pavement adjacent an excavation such as the trench 164 illustrated in FIG. 2. The tractor can then be caused to move slowly from the position shown for continued augering or the boom 16 can be hydraulically repositioned continuously to keep forcing the auger 72 into the face 166. Hence, extremely long bores can be made using an auger having an extended shank 70 as illustrated in FIG. 2 which hitherto has not been possible.

Vertical augering is also possible utilizing a configuration of the hydraulic power unit 64 about the pivot axis 128 as depicted in FIG. 3 so as to provide augering in an axis 114 which is vertical, or is of any desired angle in the plane of articulation of boom 16, inasmuch as unit 64 can simply be pivoted about pivot axis 128' with respect to yoke 60. Bracket 56 is hydraulically positioned by actuation of hydraulic cylinder 45 for creating an orientation of the plane of attachment 59 as depicted so as to permit pivoting if desired about swivel axis 100 which, in the orientation provided in FIG. 3, is parallel with the augering axis 114. Accordingly, the augering orientation illustrated in FIG. 3 makes possible swiveling of yoke 60 about swivel axis 100 for multiple boring of holes by means of auger 72' without repositioning of the boom, much less tractor 12. This was heretofore impossible with known augering apparatus. Of course, augering along an axis 114 offset, as shown in FIG. 5, from both the vertical and the plane of articulation of the boom is readily facilitated since yoke 60 is free to swivel relative to bracket 56 as shown in FIG. 5 while the hydraulic power unit 64 is pivoted about pivot axis 128 with 360° of freedom of movement.

Accordingly, the new augering accessory may be utilized for horizontal augering or boring under roads, drives, sidewalks, trees, etc. or it may be used for vertical boring for installation of posts, poles, foundations and other deep excavations, or for planting of trees and shrubs and the like. And, as noted, augering or boring is possible at various angles to the vertical or to the horizontal.

Further advantages of the new apparatus are illustrated by reference to FIG. 5 from which it will be appreciated that auger 72' may be installed by attachment to coupling 68 while hydraulic power unit 64 is placed in a desired orientation for insertion of the shank 70' into the coupling 68. Since unit 64 tends to remain in the position in which it is oriented by virtue of the friction between the trunnions 120, 120' and trunnion receiving surfaces, it is possible for the heavy auger to be lifted by one man and inserted into the opening 110 of coupling 68 thereby obviating a need for extra personnel or cumbersome positioning of unit 64.

However, the frictional resistance against pivoting provided by the lining 128 between the trunnions and trunnion receiving bearings is not so excessive as to preclude normal movement of unit 64 relative to the boom under the stresses of augering as is desired for reorientation of the boom during augering, nor does it prevent normal reorientation of the auger axis as may be desired for carrying out augering after the auger is first installed in the unit. Thus, it is possible to orient unit 64 with axis 114 in a horizontal orientation as shown in FIG. 6, to couple the auger shank to coupling to 68, and then to reposition the auger such as to the orientation illustrated in FIG. 3 for augering.

Figure 7:
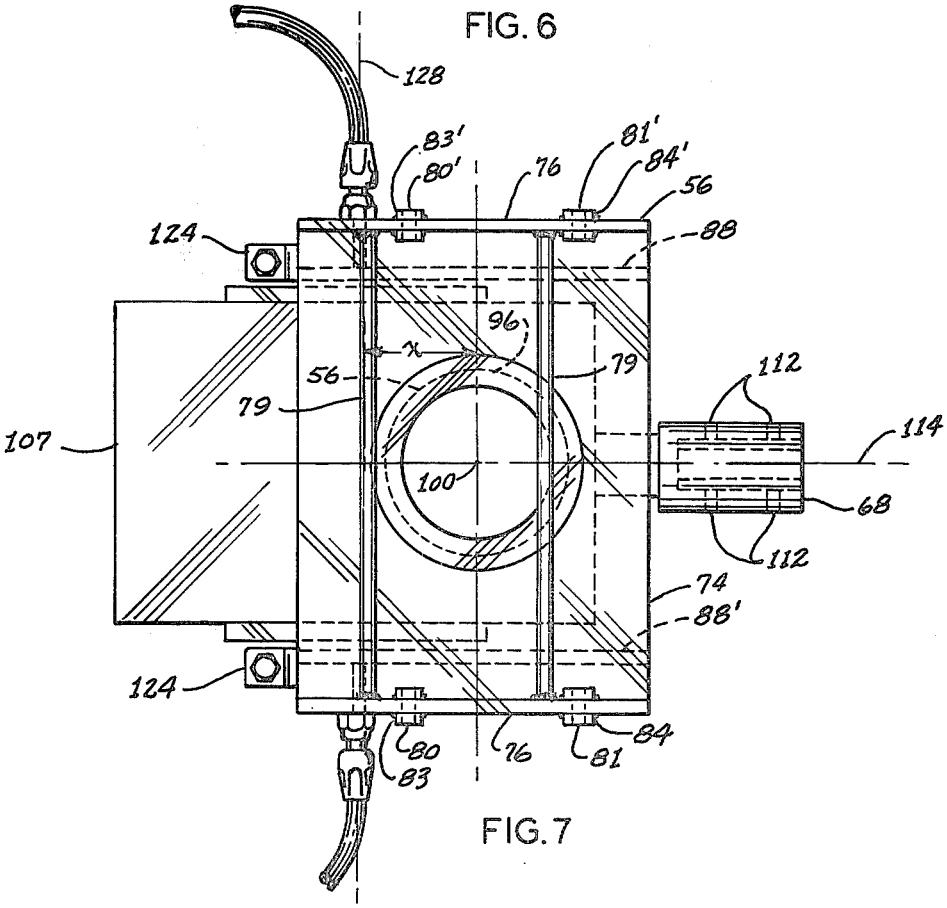
FIG. 7 is the top elevation of the new apparatus as viewed along line 7—7 in FIG. 6.

An important advantage of the operation is also understood by reference to FIGS. 6 and 7. Because the pivot axis 128 provided by the trunnions is radially offset by a distance x from swivel axis 100, i.e. is rearward thereof relative to coupling 68, the new apparatus provides a castering of the enclosure of unit 64 relative to swivel axis 100 responsive to augering thrust forces causing the enclosure to be inherently self-centering about the swivel axis, in contrast with the previously known arrangements for augering. Hence, the thrust of the auger through axis 114 acts to cause yoke 60 to be castered about swivel axis 100 for providing an inherently self-aligning action of the apparatus relative to the auger thereby providing reduced bending force on the auger and equalizing the forces which are introduced in the various members of the apparatus thereby contributing to its durability and effectiveness.

In view of the foregoing description, it will be seen that the objects of the invention are achieved and various other advantages are also attained. Although the foregoing description discloses the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be as interpreted as illustrative rather than limiting.

What is claimed is:

1. Augering apparatus for attachment to the boom of a machine for earth excavation, said boom extending from said machine and having a distal end selectively positionable in azimuth, elevation and reach from said machine, said distal end having pins transverse to said boom for attachment of an earth excavating scoop or the like, said apparatus comprising a bracket for securement to said pins, a yoke carried by said bracket in swiveling relationship thereto to provide a swivel axis, said yoke having side members extending in a direction away from said bracket, a fluid power unit disposed between said side members, said power unit having pivot members, said side members being secured to said pivot members in pivotal relationship to provide a pivot axis normal to said swivel axis, said power unit having a fluid motor, a shaft driven by said motor, auger coupling means extending from said shaft for coupling to the shank of the auger for rotation about an axis normal to said pivot axis, said pivot axis being radially offset from said swivel axis for castering of said yoke about said swivel axis in response to augering thrust forces, and fluid conduit means extending to said enclosure means for supplying fluid operation of said motor.

2. Augering apparatus for attachment to a hydraulically operated boom of a tractor-mounted backhoe or the like, said boom extending from said tractor having articulated first and second boom members relatively movable within a plane of articulation, said first member being pivotally secured to said tractor, said second member having a distal end from said tractor and said distal end having points of attachment for a scoop or the like, said points of attachment being defined by a plurality of pins extending transverse to said second boom member, said apparatus comprising a mounting bracket for being carried by said pins, a yoke carried by said bracket in swiveling relationship for movement about a swivel axis, lying in said plane of articulation, said yoke having first and second oppositely disposed trunnion bearings, a hydraulic power unit having an enclosure including trunnions extending from opposite sides thereof for pivotally cooperating with said first and second trunnion bearings, said trunnions being journalled in said trunnion bearings for permitting pivotal movement of said enclosure about a horizontal pivot axis extending through said trunnions, said trunnion bearings being selectively adjustable in tightness about said trunnions for providing a preselected frictional resistance to pivotal movement of said enclosure about said horizontal pivot axis, said enclosure containing a hydraulic motor, a shaft driven by said motor, auger coupling means carried by said shaft and extending from one end of said enclosure for coupling the shank of an auger to said shaft for being rotated by said motor, and fluid conduit means for supplying hydraulic fluid for operation of said motor.

3. Augering apparatus according to claim 2, and further characterized by said trunnions each being cylindrical, said trunnion bearings each comprising a first semicylindrical portion carried by said yoke and a second semicylindrical portion adjustably secured to said first portion for clamping a respective one of said trunnions therebetween.

4. Augering apparatus according to claim 3 and further characterized by said fluid conduit means comprising a pair of flexible hydraulic lines respectively connected at each of said trunnions.

5. Augering apparatus according to claim 4 and further characterized by said hydraulic lines each being connected to a respective trunnion by a swivel fitting coaxial with said horizontal pivot axis.

6. Augering apparatus according to claim 2 and further characterized by said swivel axis and the axis of rotation of said auger coupling means being coplanar and lying in a vertical plane, said horizontal pivot axis being normal to said vertical plane.

7. Augering apparatus according to claim 6 and further characterized by said horizontal pivot axis being radially offset from said swivel axis for castering of said yoke about said swivel axis in response to augering thrust forces.

8. Augering apparatus according to claim 2, said boom having hydraulically-actuated devices for positioning of members thereof said backhoe including a source of hydraulic fluid under pressure, said apparatus further characterized by means for selectively proportioning pressure of said fluid between said devices.

9. Augering apparatus according to claim 8 and further characterized by said fluid conduit means comprising first and second conduits for supply and return, respectively, of hydraulic fluid for said motor, fluid control valve means for controlling rotation of said fluid motor by selectively supplying fluid pressure to one of said conduits, boom control valve means for controlling positioning of said boom, said proportioning means comprising a proportioning valve interposed between said fluid pressure source and both said drill control valve means and said boom control valve means.

10. Augering apparatus for quick attachment to a hydraulically operated boom of a tractor-mounted backhoe or the like, said boom extending from said tractor and having articulated first and second boom members relatively movable within a plane of articulation, said first boom member having a proximal end pivotally secured to said tractor, said second member having a distal end positionable by hydraulic actuation means in azimuth, elevation and reach from said tractor, said distal end having points of attachment for a scoop or the like, said points of attachment being defined by a parallel set of pins having axes extending transverse to said second boom member, and lying commonly in a plane of attachment, means for relative positioning of said pins for rotation of said plane of attachment about a tipping axis normal to said plane of articulation, said apparatus comprising a mounting bracket, having a transverse web and a pair of side webs integral therewith presented at the opposite sides of said transverse web and extending upwardly therefrom, said pins extending through said side webs for securement of said bracket to the distal end of said second boom member, a yoke having a transverse web pivotally secured to said bracket transverse web for movement about a swivel axis lying in said plane of articulation, said yoke having a pair of side webs integral therewith and extending in a direction away from said bracket transverse web, a hydraulic power unit including an enclosure having a pair of trunnion journals carried by each of said yoke side webs for journalling said trunnions to permit pivotal movement of said enclosure about an enclosure pivot axis normal to said swivel axis, a selectively reversible hydraulic motor within said enclosure, a shaft driven by said motor, auger coupling means carried by said shaft and extending from one end of said enclosure, the axis of rotation of said shaft being normal to said pivot axis and coplanar with said swivel axis, said trunnion journals being positioned to locate said pivot axis radially offset from said swivel axis for castering of said yoke about said swivel axis in response to augering thrust forces, and fluid conduit means for supplying hydraulic fluid to said motor.

11. Augering apparatus according to claim 10 and further characterized by said fluid conduit means comprising a pair of flexible hydraulic lines respectively connected at each of said trunnions.

12. Augering apparatus according to claim 11 and further characterized by each said hydraulic line being connected at each trunnion by a respective socket fitting coaxial with said pivot axis.

13. Augering apparatus according to claim 12 and further characterized by said bracket transverse web comprising a plate having an aperture therethrough, said yoke transverse web comprising a plate and a cylindrical collar secured thereto and extending upward from a face of the last-said plate through said aperture in close-fitting journalled relationship thereto, and a flange secured to said collar and extending radially outward therefrom for retaining said collar in said aperture with said apertured bracket plate interposed between said yoke plate and said flange.

14. Augering apparatus according to claim 13 and further characterized by said bracket and yoke each being channel-shaped in cross-section to provide said bracket and yoke respective interior surfaces opening in opposite directions.

15. Augering apparatus for attachment to a hydraulically operated boom of a tractor-mounted backhoe or the like, said boom extending from said tractor having articulated first and second boom members relatively movable within a plane of articulation, said first member being pivotally secured to said tractor, said second member having a distal end hydraulically positionable in azimuth, elevation and reach from said tractor and said distal end having points of attachment for a scoop or the like, said points of attachment being defined by a plurality of pins extending transverse to said second boom member, said apparatus comprising a mounting bracket for being carried by said pins, a yoke carried by said bracket in swiveling relationship for movement about a swivel axis, lying in said plane of articulation, said yoke having first and second oppositely disposed trunnion bearings, a hydraulic power unit having an enclosure including trunnions extending from opposite sides thereof for pivotally cooperating with said first and second trunnion bearings, said trunnions being journalled in said trunnion bearings for permitting pivotal movement of said enclosure about a horizontal pivot axis extending through said trunnions, said enclosure containing a hydraulic motor, a shaft driven by said motor, auger coupling means carried by said shaft and extending from one end of said enclosure for coupling the shank of an auger to said shaft for being rotated by said motor, said swivel axis and the axis of rotation of said auger coupling means being coplanar and lying in a vertical plane, said horizontal pivot axis being normal to said vertical plane, and being radially offset from said swivel axis for castering of said yoke about said swivel axis in response to augering thrust forces, and fluid conduit means for supplying hydraulic fluid for operation of said motor.

* * * * *